US011408227B2

(12) United States Patent
Wan et al.

(10) Patent No.: US 11,408,227 B2
(45) Date of Patent: Aug. 9, 2022

(54) HORIZONTAL DRILLING MACHINE WITH IMPACT DEVICE

(71) Applicant: HUNAN UNIVERSITY OF SCIENCE AND TECHNOLOGY, Hunan (CN)

(72) Inventors: Buyan Wan, Hunan (CN); Yongping Jin, Hunan (CN); Fenfei Peng, Hunan (CN); Jialiang Wang, Hunan (CN); Huan Liu, Hunan (CN)

(73) Assignee: HUNAN UNIVERSITY OF SCIENCE AND TECHNOLOGY, Xiangtan (CN)

( * ) Notice: Subject to any disclaimer, the term of this patent is extended or adjusted under 35 U.S.C. 154(b) by 0 days.

(21) Appl. No.: 17/485,739

(22) Filed: Sep. 27, 2021

(65) Prior Publication Data

US 2022/0010622 A1 Jan. 13, 2022

(30) Foreign Application Priority Data

Dec. 18, 2020 (CN) ..... 202011498580.3

(51) Int. Cl.

| | |
|---|---|
| ***E21B 1/38*** | (2006.01) |
| ***E21B 1/26*** | (2006.01) |
| ***E21B 7/04*** | (2006.01) |
| ***E21B 31/113*** | (2006.01) |
| ***E21B 4/06*** | (2006.01) |
| ***E21B 15/04*** | (2006.01) |
| ***E21B 25/00*** | (2006.01) |

(52) U.S. Cl.

CPC ..... *E21B 1/38* (2020.05); *E21B 1/26* (2020.05); *E21B 4/06* (2013.01); *E21B 7/046* (2013.01); *E21B 15/04* (2013.01); *E21B 25/00* (2013.01); *E21B 31/113* (2013.01)

(58) Field of Classification Search

CPC ... E21B 1/38; E21B 1/26; E21B 7/046; E21B 31/113; E21B 31/107; E21B 25/00; E21B 4/14; E21B 4/20; E21B 15/04; E21B 19/10; E21B 25/16; E21B 31/06; E21B 4/06

See application file for complete search history.

(56) References Cited

U.S. PATENT DOCUMENTS

| | | | | |
|---|---|---|---|---|
| 1,611,504 | A * | 12/1926 | Baker | E21B 25/00 175/235 |
| 10,704,350 | B2 * | 7/2020 | Wan | E21B 25/18 |
| 11,041,344 | B1 * | 6/2021 | Wan | E21B 15/02 |
| 2019/0338610 | A1 * | 11/2019 | Shan | E21B 25/005 |
| 2022/0010624 | A1 * | 1/2022 | Wan | E21B 7/046 |
| 2022/0010640 | A1 * | 1/2022 | Wan | E21B 25/16 |

* cited by examiner

*Primary Examiner* — Jonathan Malikasim

(57) ABSTRACT

A horizontal drilling machine with an impact device, including a support frame, an armored cable, a cable-straightening mechanism, a cable-feeding mechanism, a power head, a drill pipe, a rotating chuck, a damper, a fishing device with the impact device, a core tube and a thrust cylinder. One end of the thrust cylinder is hinged with the support frame, and the other end of the thrust cylinder is connected to the power head. The power head is arranged on a slid rail of the support frame. An active drill pipe of the power head is connected to the drill pipe. An end of the armored cable is connected to a control system, and the other end is connected to the fishing device in the drill pipe. A fishing head of the fishing device is connected to a spearhead of the core tube.

9 Claims, 5 Drawing Sheets

HORIZONTAL DRILLING MACHINE WITH IMPACT DEVICE

CROSS-REFERENCE TO RELATED APPLICATIONS

This application claims the benefit of priority from Chinese Patent Application No. 202011498580.3, filed on Dec. 18, 2020. The content of the aforementioned application, including any intervening amendments thereto, is incorporated herein by reference in its entirety.

TECHNICAL FIELD

This application relates to geological exploration, and more particularly to a horizontal drilling machine.

BACKGROUND

The trenchless horizontal directional technology is one of the most important indicators to measure the national technical level in the trenchless field, and plays a core role in promoting the development of horizontal directional drilling technology, which has good social benefits and application prospects. As a commonly-used device in the trenchless drilling, the horizontal drilling machine plays an important role in the geological exploration.

The operation process of the existing horizontal drilling machines in the hard-rock drilling process is described as follows. (1) An active drill pipe is connected to a screw motor. (2) A hydraulic impact drilling tool is connected to the screw motor. (3) The impact rock-fragmentation drilling operation is performed. (4) The drilling tool is taken out after the operation is completed. The existing horizontal drilling machines can satisfy the demand for non-core drilling detection, but they still struggle with the following drawbacks. Firstly, the existing horizontal drilling machine has low drilling efficiency and high costs. Secondly, the single operation mode is not suitable for the core drilling. With the increase of the exploration depth, especially when the exploration depth reaches hundreds of meters or thousands of meters, the drilling operation will become extremely time-consuming.

SUMMARY

An object of this application is to provide a horizontal drilling machine with an impact device to solve the above technical problems, where the horizontal drilling machine has a simple and compact structure and convenient operations, and can greatly increase the drilling efficiency and collect an intact core sample.

The technical solutions of this application are described as follows.

This application provides a horizontal drilling machine with an impact device, comprising:

a control system;
a support frame;
an armored cable;
a cable-straightening mechanism;
a cable-feeding mechanism;
a washing pump;
a power head;
a drill pipe;
a drilling tool;

a fishing device with the impact device;
a core tube; and
a thrust cylinder;

wherein the cable-straightening mechanism and the cable-feeding mechanism are fixedly provided on the support frame; one end of the thrust cylinder is hinged with the support frame, and the other end of the thrust cylinder is connected to the power head through a connecting block; the power head is arranged on a slid rail of the support frame, and the thrust cylinder can drive the power head to move on the slid rail through extension and retraction of a piston rod; the power head is connected to the drill pipe through an active drill pipe to drive the drill pipe to rotate; one end of the armored cable is connected to the control system, and the other end of the armored cable passes through the cable-straightening mechanism, the cable-feeding mechanism and a sealing joint to be connected to the fishing device with the impact device in the drill pipe; the armored cable is wound on a storage rack, a fishing head of the fishing device with the impact device is connected to a spearhead of the core tube to lower and recover the drilling tool; the impact device of the fishing device is configured to transmit an impact force to the drill pipe through a transmission block to perform impact vibration drilling on hard formation; the sealing joint is arranged on the power head and is communicated with an inner cavity of the active drill pipe; a water outlet of the washing pump is communicated with the inner cavity of the active drill pipe through a rotating water-supply device; and the rotating water-supply device is arranged on the power head.

In an embodiment, the cable-straightening mechanism comprises multiple sets of rolling wheels. The multiple sets of rolling wheels are fixedly arranged on the support frame, each set of rolling wheels comprises two rolling wheels; axes of the two rolling wheels in the same set are located in a vertical plane; and vertical planes in which axes of the multiple sets of rolling wheels are located are parallel to each other.

In an embodiment, the cable-feeding mechanism comprises a box body, an upper friction wheel and a lower friction wheel. The upper friction wheel and the lower friction wheel are fixedly arranged in the box body; an axis of the upper friction wheel is parallel to an axis of the lower friction wheel; the axis of the upper friction wheel and the axis of the lower friction wheel are located in a vertical plane; and the vertical plane in which the axes of the upper friction wheel and the lower friction wheel are located is parallel to the vertical planes in which the axes of the multiple sets of rolling wheels are located. The box body is provided with a through-hole for the armored cable to pass through; and a wheel shaft of the lower friction wheel is connected to a motor via a speed reducer.

In an embodiment, the horizontal drilling machine further comprises a rotating chuck and a damper. The rotating chuck and the damper are arranged on an end of the support frame near a drill hole; the damper is configured to clamp the drill pipe, and the rotating chuck is configured to connect the drill pipe with the active drill pipe.

In an embodiment, the power head comprises a motor, a reduction gearbox, a transmission shaft and the active drill pipe. The motor is arranged on the reduction gearbox, and an output shaft of the motor is located in the reduction gearbox. The output shaft of the motor is provided with a driving gear. The transmission shaft is arranged in the reduction gearbox and is provided with a first driven gear and a second driven gear. The active drill pipe is arranged on the reduction gearbox and is provided with a third driven gear. The driving gear is engaged with the first driven gear, and the second driven gear is engaged with the third driven gear. An axis of the output shaft of the motor is parallel to the transmission shaft and the active drill pipe, and an end of the active drill pipe extending out of the reduction gearbox is provided with a screw thread.

In an embodiment, a diameter of the sealing joint is larger than that of a steel pipe, and a seal ring is arranged in the sealing joint.

In an embodiment, the damper comprises a first oil cylinder, a second oil cylinder, two slip assemblies, a top plate, a bottom plate, and two side plates. The top plate and the bottom plate and the two side plates together form a square tubular structure; and the square tubular structure is arranged on the support frame. The top plate is provided with a first drill pipe hole for the drill pipe to pass through; and the bottom plate is provided with a second drill pipe hole for the drill pipe to pass through; and the first and second drill pipe holes are coaxially provided. The two slip assemblies are respectively arranged on both sides of the first and second drill pipe holes; and slips of the two slip assemblies are arranged opposite to each other. The first oil cylinder and the second oil cylinder are arranged on the support frame, and respectively located at two ends of the square tubular structure; and piston rods of the first oil cylinder and the second oil cylinder II are arranged opposite to each other and are respectively connected to the two slip assemblies.

In an embodiment, the rotating chuck comprises an oil motor, a reduction gearbox, a first transmission shaft, a second transmission shaft, a protecting tube, a rotating oil-separating tube, a fixed oil-separating tube, a slip assembly and a centralizer. The oil motor is arranged on the reduction gearbox; an output shaft of the oil motor is located in the reduction gearbox. The output shaft of the oil motor is provided with a driving gear. The first transmission shaft is provided in the reduction gearbox, and the first transmission shaft and the second transmission shaft are arranged in the reduction gearbox; the first transmission shaft is provided with a first driven gear and a second driven gear; the second transmission shaft is provided in the reduction gearbox; the second transmission shaft is provided with a third driven gear and a fourth driven gear. The fixed oil-separating tube is arranged on a bottom plate of the reduction gearbox; an annular oil groove is arranged on a side of the fixed oil-separating tube; the fixed oil-separating tube is sleeved in the rotating oil-separating tube. The rotating oil-separating tube is provided with a fifth driven gear. The driving gear is engaged with the first driven gear, the second driven gear is engaged with the third driven gear; and the fourth driven gear is engaged with the fifth driven gear. Axes of the output shaft of the oil motor, the first transmission shaft, the second transmission shaft and the fixed oil-separating tube are parallel to each other and are located in the same plane. The protecting tube is connected to the reduction gearbox through a bolt. The slip assembly is arranged in the protecting tube and is connected to the rotating oil-separating tube. The centralizer is arranged on the protecting tube. The reduction gearbox is fixedly arranged on the support frame; and the fixed oil-separating tube is coaxial with the drill pipe.

In an embodiment, the fishing device with an impact device comprises a casing, a motor, a driving gear, a driven gear, a pneumatic piston, a trapezoidal cone head, an impact plate, and an electromagnet. The casing has a barrel-shaped structure, and two ends of the casing are respectively provided with an end cover. The motor, the pneumatic piston and the impact plate are arranged in the casing; an inner cavity of the casing is divided by the impact plate into two cavities; the motor is arranged in one of the two cavities; and an output shaft of the motor is provided with the driving gear. The driving gear is engaged with the driven gear; a rotating shaft of the driven gear is provided with a swing rod bearing; an end of a swing rod of the swing rod bearing is hinged with the pneumatic piston; the pneumatic piston is arranged in a piston cylinder; and the piston cylinder is fixedly connected to the impact plate. The other of the two cavities is provided with the electromagnet, two transmission blocks and the trapezoidal cone head. The electromagnet is arranged in a middle of an end surface of the impact plate and is connected to the armored cable. A side wall of the casing is provided with two through holes; the two through holes are coaxial; the two transmission blocks are respectively in the two through holes, and are connected through a first spring. The trapezoidal cone head is arranged between the two transmission blocks; a smaller end of the trapezoidal cone head faces toward the electromagnet; and a second spring is arranged between a larger end of the trapezoid cone head and the end cover.

Compared with the prior art, the present disclosure has the following beneficial effects.

The present disclosure realizes the delivery and recovery of a horizontal drilling machine by utilizing the pressure of a fluid medium and the pushing of the armored cable, and at the same time, the impact device of the fishing head is powered by the armored cable to render the electromagnet in the fishing head magnetic to attract the trapezoidal cone head connected to the spring I to move upward, so that the two transmission blocks extend out of the casing to be clamped into the corresponding position of the drill pipe. At this time, the motor of the impact device is working and drives the pressure piston connected to the crank to move back and forth, and thus transmitting the impact force to the drill pipe through the transmission block to achieve the impact drilling. After the drilling, the armored cable stops supplying power, and the motor stops working. At this time, the electromagnet loses the magnetism, so that the trapezoidal cone head is reset under the elastic effect of the spring, and the two transmission blocks are also reset. And then the core tube is lifted out, and the round trip of drilling is completed. In this way, the drilling and coring of strata can be realized, which can satisfy the coring and rapid drilling demand for hard strata. The horizontal drilling machine provided herein has a simple and compact structure and convenient operations.

Figure 1:
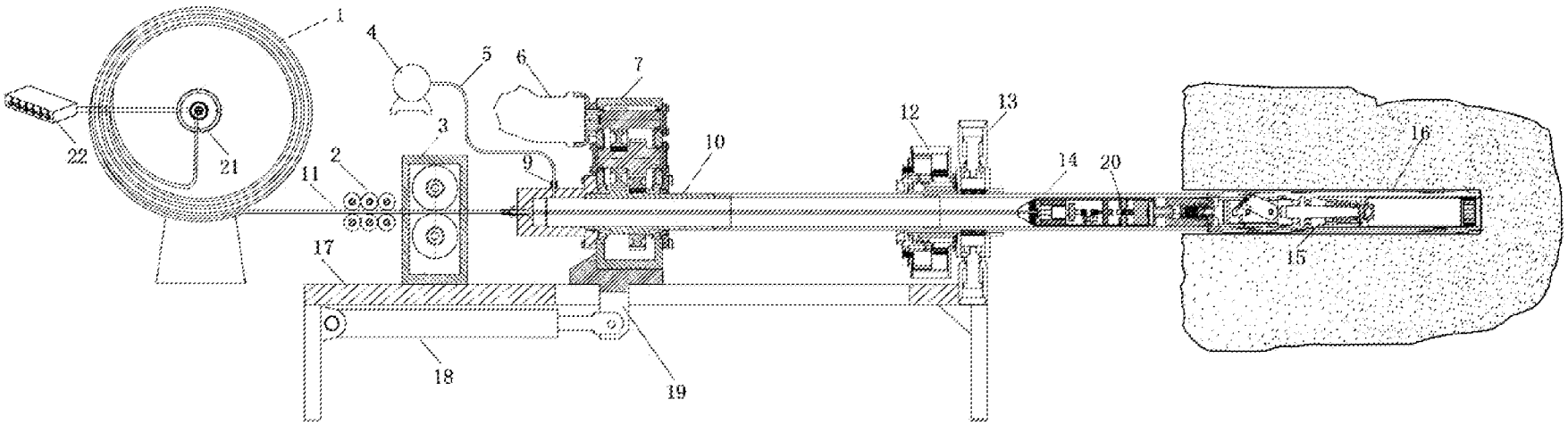
FIG. 1 is a structural diagram of a horizontal drilling machine with an impact device according to an embodiment of this disclosure.

In the drawings, 1, storage rack; 2, cable-feeding mechanism; 3, cable-straightening mechanism; 4, washing pump; 5, water pipe; 6, motor; 7, power head; 8, sealing joint; 9, rotating water-supply device; 10, active drill pipe; 11, armored cable; 12, rotating chuck; 13, damper; 14, drill pipe; 15, drilling tool; 16, core tube; 17, support frame; 18, thrust cylinder; 19, connecting block; 20, fishing device; 21, photoelectric slip ring; and 22, control system.

DETAILED DESCRIPTION OF EMBODIMENTS

The disclosure will be further described below in detail with reference to the accompanying drawings and embodiments.

As shown in FIG. 1, an embodiment of the disclosure provides a horizontal drilling machine with an impact device, including a storage rack 1, a cable-feeding mechanism 2, a cable-straightening mechanism 3, a water pipe 5, a motor 6, a power head 7, a sealing joint 8, a rotating water-supply device 9, an active drill pipe 10, an armored cable 11, a rotating chuck 12, a damper 13, a drill pipe 14, a drilling tool 15, a core tube 16, a support frame 17, a thrust cylinder 18, a connecting block 19, a fishing device 20 with the impact device, a photoelectric slip ring 21, and a control system 22. The cable-straightening mechanism 3, the cable-feeding mechanism 2, the rotating chuck 12 and the damper 13 are fixed on the support frame 17 in sequence from left to right. A right end of the support frame 17 is arranged near a drill hole. The cable-straightening mechanism 3 includes multiple sets of rolling wheels. The multiple sets of rolling wheels are fixedly arranged on the support frame, and each set includes two rolling wheels. The axes of the two rolling wheels in the same set are located in a vertical plane, and the planes on which the axes of the multiple sets of rolling wheels are located are parallel to each other. The cable-feeding mechanism 2 includes a box body, an upper friction wheel and a lower friction wheel. The upper friction wheel and the lower friction wheel are fixedly arranged in the box body, and an axis of the upper friction wheel is parallel to that of the lower friction wheel. The axes of the upper friction wheel and the lower friction wheel are located in the same vertical plane, and the vertical plane is parallel to the vertical plane on which the axes of each set of rolling wheels are located. The box body is provided with a through hole for the armored cable to pass through. A wheel shaft of the lower friction wheel is connected to the motor 6 via a speed reducer. One end of the thrust cylinder 18 is hinged with the support frame 17, and the other end of the thrust cylinder 18 is connected to the power head 7 through the connecting block 19. The power head is arranged on a slid rail of the support frame 17. A piston rod of the thrust cylinder 18 can drive the power head 7 to move back and forth on the slid rail by extension and retraction. The control system 22 is connected to the fishing device 20 through the armored cable 11, and the power on/off of the fishing device 20 is controlled by the control system 22.

Figure 2:
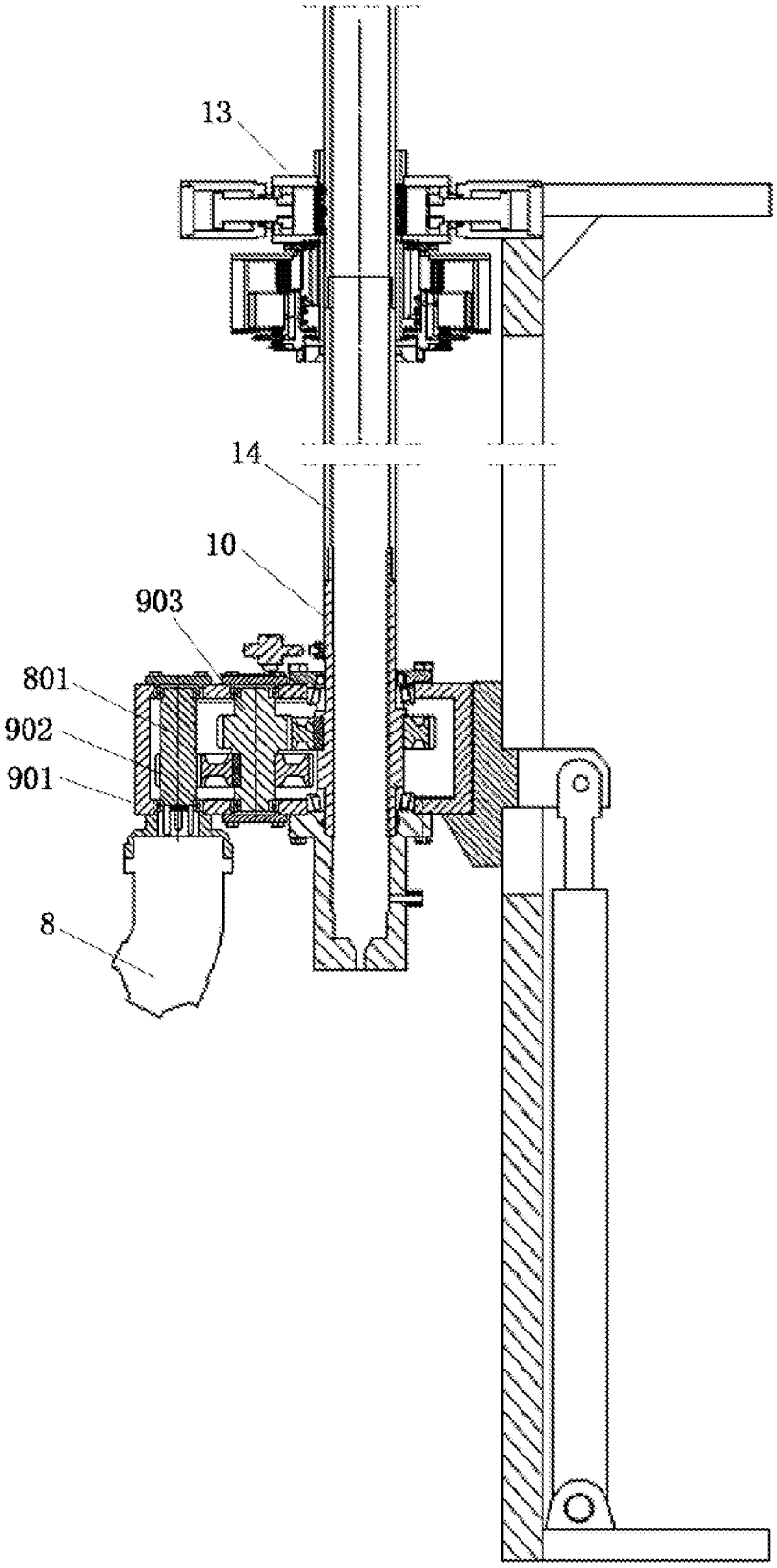
FIG. 2 is a sectional view of a power head of the horizontal drilling machine according to an embodiment of this disclosure.

Referring to an embodiment illustrated in FIG. 2, the power head 7 includes the motor 6, a reduction gearbox 901, a transmission shaft 903 and the active drill pipe 10. The motor 6 is arranged on the reduction gearbox 901, and an output shaft 801 of the motor 6 is located in the reduction gearbox 901 and is provided with a driving gear 902. The transmission shaft 903 is arranged in the reduction gearbox 901, and is provided with a driven gear I and a driven gear II. The active drill pipe 10 is arranged on the reduction gearbox 901 and is provided with a driven gear III. The driving gear 902 is engaged with the driven gear I, and the driven gear II is engaged with the driven gear III. An axis of the output shaft 801 of the motor is parallel to the transmission shaft 903 and the active drill pipe 10. An end of the active drill pipe 10 extending out of the reduction gearbox 901 is threadedly connected to the drill pipe 14.

Figure 3:
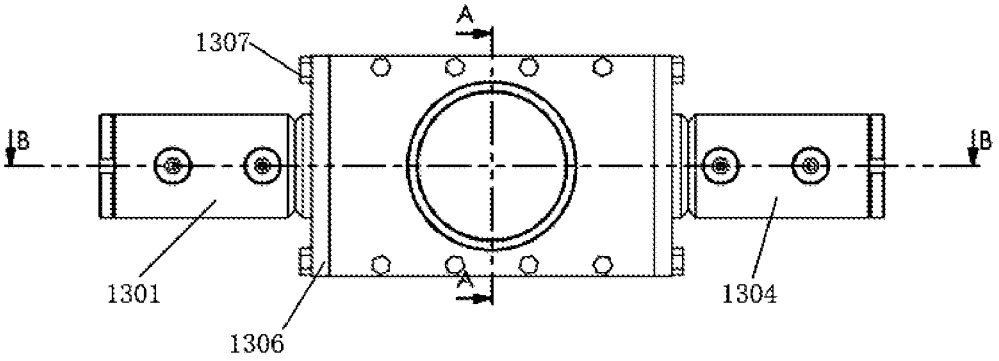
FIG. 3 is a front view of a damper of the horizontal drilling machine according to an embodiment of this disclosure.
Figure 4:
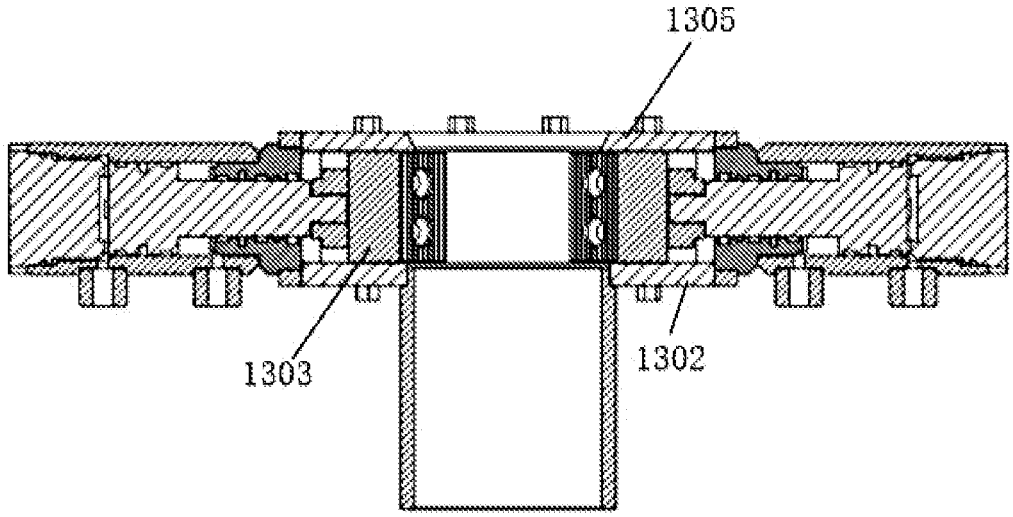
FIG. 4 is a sectional view along B-B line in FIG. 3.

In an embodiment, the damper 13 is arranged for clamping the drill pipe 14 to guide the drill pipe 14. As shown in FIG. 3 and FIG. 4, the damper 13 includes an oil cylinder I 1301, an oil cylinder II 1304, two slip assemblies 1303, a top plate 1305, a bottom plate 1302, and two side plates 1306. The top plate 1305 and the bottom plate 1302 are connected to the two side plates 1306 through bolts 1307 to form a square tubular structure, and the square tubular structure is arranged on the support frame 17. The top plate 1305 is provided with a first drill pipe hole for the drill pipe to pass through, and the bottom plate 1302 is provided with a second drill pipe hole for the drill pipe to pass through; and the first and second drill pipe holes are coaxially provided. The two slip assemblies 1303 are respectively arranged on both sides of the drill pipe holes, and the slips of the two slip assemblies 1303 are arranged opposite to each other. The oil cylinder I 1301 and the oil cylinder II 1304 are arranged on the support frame, and respectively located at two ends of the square tubular structure; piston rods of the oil cylinder I 1301 and the oil cylinder II 1304 are arranged opposite to each other, and are respectively connected to the two slip assemblies 1303. The oil cylinder I 1301 and the oil cylinder II 1304 promote the relative movement of the two slip assemblies 1303 to clamp the drill pipe 14.

Figure 5:
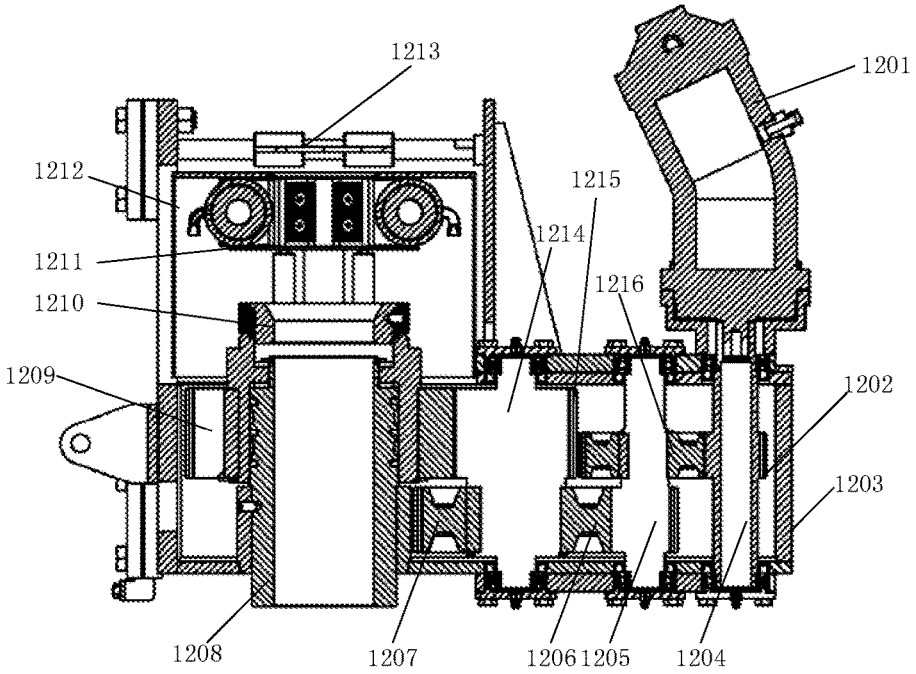
FIG. 5 is a sectional view of a rotating chuck of the horizontal drilling machine according to an embodiment of this disclosure.

In an embodiment illustrated in FIG. 5, the rotating chuck 12 includes an oil motor 1201, a reduction gearbox 1203, a transmission shaft I 1205, a transmission shaft II 1214, a protecting tube 1212, a rotating oil-separating tube 1210, a fixed oil-separating tube 1208, a slip assembly 1211 and a centralizer 1213. The oil motor 1201 is arranged on the reduction gearbox 1203, and an output shaft 1204 of the oil motor 1201 is provided in the reduction gearbox 1203. The output shaft 1204 of the oil motor 1201 is provided with a driving gear II 1202. The transmission shaft I 1205 and the transmission shaft II 1214 are arranged in the reduction gearbox 1203, the transmission shaft I 1205 is provided with a driven gear IV 1216 and a driven gear V 1206, and the transmission shaft II 1214 is provided with a driven gear VII 1215 and a driven gear VI 1207. The fixed oil-separating tube 1208 is arranged on a bottom plate of the reduction gearbox 1203; an annular oil groove is arranged on a side of the fixed oil-separating tube 1208, and the fixed oil-separating tube 1208 is sleeved in the rotating oil-separating tube 1210. The rotating oil-separating tube 1210 is provided with a driven gear VIII 1209. The driving gear II 1202 is engaged with the driven gear IV 1216, and the driven gear V 1206 is engaged with the driven gear VI 1207, the driven gear VII 1215 is engaged with the driven gear VIII 1209. Axes of the output shaft 1204 of the oil motor, the transmission shaft I 1205, the transmission shaft II 1214 and the fixed oil-separating tube 1208 are parallel to each other and are located in the same plane. The protecting tube 1212 is connected to the reduction gearbox 1203 through a bolt. The slip assembly 1211 is arranged in the protecting tube 1212 and is connected to the rotating oil-separating tube 1210. The centralizer 1213 is arranged on the protecting tube 1212 and plays a centralizing role on the drill pipe. The reduction gearbox is fixedly arranged on the support frame, and the fixed oil-separating tube is coaxial with the drill pipe.

The armored cable 11 is wound on a storage rack 1. An end of the armored cable 11 is connected to the control system 23, and the other end of the armored cable 11 is connected to the fishing device with the impact device 20 arranged in the drill pipe 14 through the cable-straightening mechanism 3, the cable-feeding mechanism 2 and the sealing joint 8. The sealing joint 8 is arranged on the power head 7 and is communicated with an inner cavity of the active drill pipe 10. The diameter of the sealing joint 8 is larger than that of the armored cable 11, and a seal ring is arranged between the sealing joint 8 and the armored cable 11.

Figure 6:
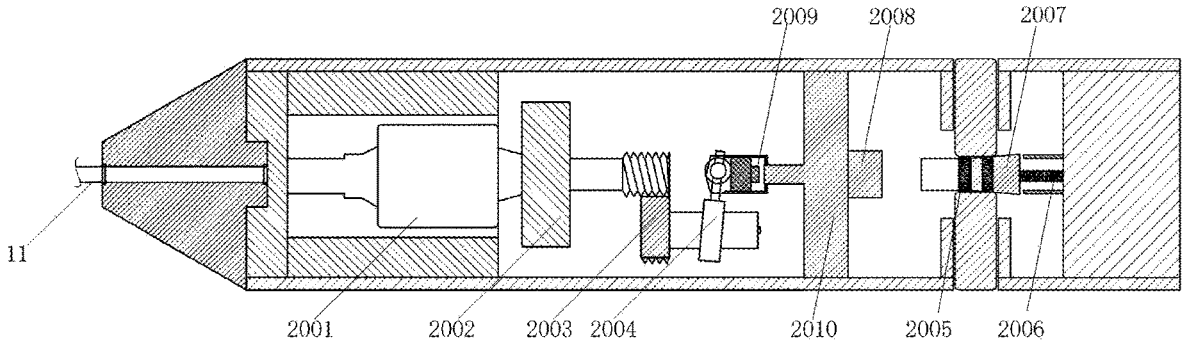
FIG. 6 is a sectional view of the impact device of a fishing device according to an embodiment of this disclosure.

In an embodiment illustrated in FIG. 6, the fishing device 20 includes a casing, a motor 2001, a driving gear 2002, a driven gear 2003, a pneumatic piston 2009, a trapezoidal cone head 2007, an impact plate 2010, and an electromagnet 2008. The casing has a barrel-shaped structure, and two ends of the casing are respectively provided with an end cover. The motor 2001, the pneumatic piston 2009 and the impact plate 2010 are arranged in the casing. An inner cavity of the casing is divided by the impact plate 2010 into two cavities, where the motor 2001 is arranged in one of the two cavities. An output shaft of the motor 2001 is provided with the driving gear 2002. The driving gear is engaged with the driven gear 2003. A rotating shaft of the driven gear 2003 is provided with a swing rod bearing 2004. An end of the swing rod of the swing rod bearing 2004 is hinged with the pneumatic piston 2009. The pneumatic piston 2009 is arranged in a piston cylinder, and the piston cylinder is fixedly connected to the impact plate 2010. The other of the two cavities is provided with the electromagnet 2008, two transmission blocks and the trapezoidal cone head 2007. The electromagnet 2008 is arranged in a middle of the impact plate 2010 and is connected to the armored cable 11. A side wall of the casing is provided with two through holes, which are coaxially provided. The two transmission blocks are respectively in the two through holes, and are connected through a first spring 2005. The trapezoidal cone head 2007 is arranged between the two transmission blocks. A smaller end of the trapezoidal cone head 2007 faces toward the electromagnet 2008. A second spring 2006 is arranged between a larger end of the trapezoid cone head 2007 and the end cover. The electromagnet 2008 is powered on through the armored cable 11 such that the electromagnet 2008 is magnetic. The trapezoid cone head 2007 connected to the spring 2006 is attracted to move upward, so that the two transmission blocks extend out and stuck into the drill pipe 14. At this time, the motor 2001 of the impact device is working, the driving gear 2002 drives the driven gear 2003 to rotate, making the swing rod bearing 2004 to move to drive the pneumatic piston 2009 connected to the swing rod bearing 2004 to move back and forth to hit the impact plate 2010. The impact force is transmitted to the drill pipe 14 through the transmission block to achieve the impact drilling. After the drilling, the armored cable 11 stops supplying power, the motor 2001 stops working, the electromagnet 2008 loses the magnetism, so that the trapezoidal cone head 2007 is reset through the elastic action of the spring 2006, and the two transmission blocks are reset. As a result, the core tube 16 is lifted out to complete the trip.

Figure 7:
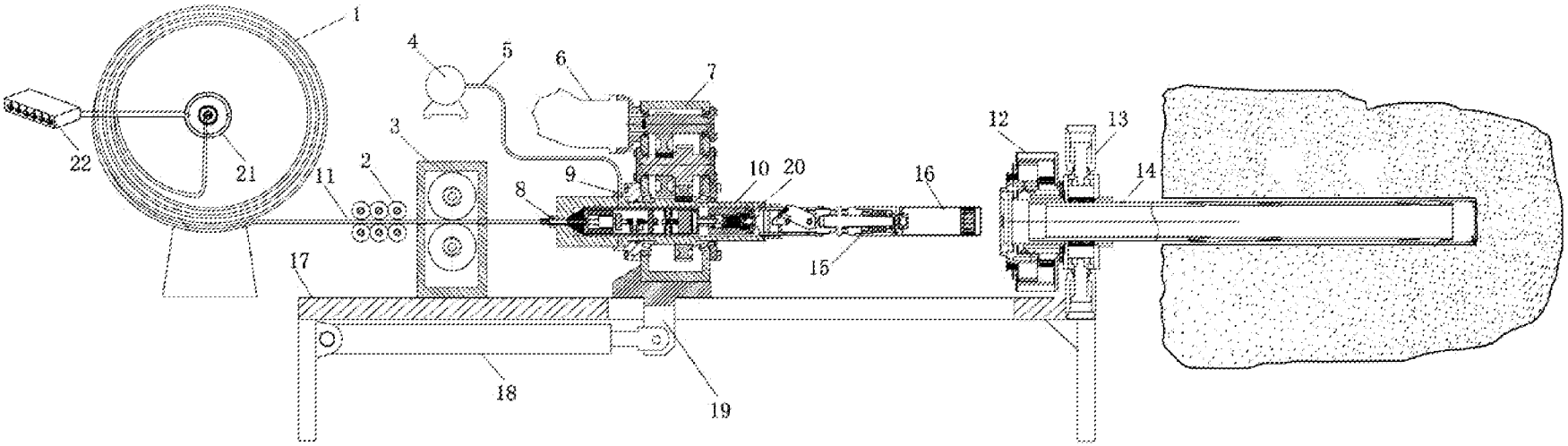
FIG. 7 schematically depicts the pipe replacement of the horizontal drilling machine according to an embodiment of this disclosure.

In an embodiment illustrated in FIG. 7, the cable-straightening mechanism 3 includes three sets of rolling wheels (the rolling wheels are not limited to three sets), the three sets of rolling wheels are fixedly arranged on the support frame 17, each set of the rolling wheel includes two rolling wheels, and the planes on which the axes of the multiple sets of the rolling wheel are located are parallel to each other. The cable-feeding mechanism 2 includes a box body, an upper friction wheel, and a lower friction wheel. The upper friction wheel and the lower friction wheel are fixedly arranged in the box body. An axis of the upper friction wheel is parallel to an axis of the lower friction wheel. The axis of the upper friction wheel and the axis of the lower friction wheel are located in a vertical plane. The vertical plane is parallel to the vertical plane in which the axes of the multiple sets of the rolling wheels are located. The box body is provided with a through-hole for the armored cable 11 to pass through. A wheel shaft of the lower friction wheel is connected to the motor via a speed reducer, the motor drives the lower friction wheel to rotate to transfer the armored cable 11.

As illustrated in FIG. 7, before the drilling operation, the active drill pipe 10 is threadedly connected to the rear end of the drill pipe 14 through the thread, and a front-end thread part of the drill pipe 14 is arranged in the rotating chuck 12. The drill pipe 14 is connected to the active drill pipe 10 through the rotating chuck 12. The damper 13 clamps and fixes the drill pipe 14. The armored cable 11 on the support frame 17 passes the sealing joint 8 to be connected to the fishing device 20, and the fishing device 20 is connected to the spearhead of the drilling tool 15. The drilling tool 15 is driven by the motor of the cable-feeding mechanism 2 to move downward to a target position. At the beginning of the drilling, the impact device in the fishing head is powered through the armored cable 11, so that the electromagnet 2008 of the in-place fishing device 20 becomes magnetic. The trapezoidal cone head 2007 connected with the spring 2006 is attracted by the electromagnet 2008 to move toward the electromagnet 2008, so that the two transmission blocks extend out of the casing to be clamped into the corresponding position of the drill pipe. At this time, the motor 2001 of the impact device works to drive the piston 2009 to reciprocate to hit the impact plate 2010, and the impact force is transmitted to the drill pipe 14 through the transmission block to achieve the impact drilling. After the drilling, the armored cable 11 stops supplying power, and the motor 2001 stops working. At this time, the electromagnet 2008 loses the magnetism, so that the trapezoidal cone head 2007 is reset under the elastic action of the spring 2006, and the two transmission blocks are also reset. The core tube 16 is lifted out, and the round trip of drilling is completed.

What is claimed is:

1. A horizontal drilling machine with an impact device, comprising:

a control system;

a support frame;

an armored cable;

a cable-straightening mechanism;

a cable-feeding mechanism;

a washing pump;

a power head;

a drill pipe;

a drilling tool;

a fishing device with the impact device;

a core tube; and a thrust cylinder;

wherein the cable-straightening mechanism and the cable-feeding mechanism are fixedly provided on the support frame; one end of the thrust cylinder is hinged with the support frame, and the other end of the thrust cylinder is connected to the power head through a connecting block; the power head is arranged on a slid rail of the support frame; and the thrust cylinder is configured to drive the power head to move on the slid rail through extension and retraction of a piston rod; the power head is connected to the drill pipe through an active drill pipe to drive the drill pipe to rotate; one end of the armored cable is connected to the control system, and the other end of the armored cable passes through the cable-straightening mechanism, the cable-feeding mechanism and a sealing joint to be connected to the fishing device with the impact device in the drill pipe; the armored cable is wound on a storage rack; a fishing head of the fishing device with the impact device is connected to a spearhead of the core tube to lower and recover the drilling tool; the impact device of the fishing device is configured to transmit an impact force to the drill pipe through a transmission block to perform impact vibration drilling on a hard formation; the sealing joint is arranged on the power head and is communicated with an inner cavity of the active drill pipe; a water outlet of the washing pump is communicated with the inner cavity of the active drill pipe through a rotating water-supply device; and the rotating water-supply device is arranged on the power head.

2. The horizontal drilling machine of claim 1, wherein the cable-straightening mechanism comprises multiple sets of rolling wheels; the multiple sets of rolling wheels are fixedly arranged on the support frame; each set of rolling wheels comprises two rolling wheels; axes of the two rolling wheels in the same set are located in a vertical plane; and vertical planes in which axes of the multiple sets of rolling wheels are located are parallel to each other.

3. The horizontal drilling machine of claim 2, wherein the cable-feeding mechanism comprises a box body, an upper friction wheel and a lower friction wheel;

the upper friction wheel and the lower friction wheel are fixedly arranged in the box body; an axis of the upper friction wheel is parallel to an axis of the lower friction wheel; the axis of the upper friction wheel and the axis of the lower friction wheel are located in a vertical plane; the vertical plane in which the axes of the upper friction wheel and the lower friction wheel are located is parallel to the vertical planes in which the axes of the multiple sets of rolling wheels are located; the box body is provided with a through-hole for the armored cable to pass through; and a wheel shaft of the lower friction wheel is connected to a motor via a speed reducer.

4. The horizontal drilling machine of claim 1, further comprising:

a rotating chuck; and a damper;

wherein the rotating chuck and the damper are arranged on an end of the support frame near a drill hole; and the damper is configured to clamp the drill pipe, and the rotating chuck is configured to connect the drill pipe with the active drill pipe or disconnect the drill pipe from the active drill pipe.

5. The horizontal drilling machine of claim 1, wherein the power head comprises a motor, a reduction gearbox, a transmission shaft and the active drill pipe; the motor is arranged on the reduction gearbox, and an output shaft of the motor is located in the reduction gearbox; the output shaft of the motor is provided with a driving gear; the transmission shaft is arranged in the reduction gearbox and is provided with a first driven gear and a second driven gear; the active drill pipe is arranged on the reduction gearbox and is provided with a third driven gear; the driving gear is engaged with the first driven gear; the second driven gear is engaged with the third driven gear; and an axis of the output shaft of the motor is parallel to the transmission shaft and the active drill pipe; and an end of the active drill pipe extending out of the reduction gearbox is threadedly connected to the drill pipe.

6. The horizontal drilling machine of claim 1, wherein a diameter of the sealing joint is larger than that of the armored cable; and a seal ring is arranged in the sealing joint.

7. The horizontal drilling machine of claim 4, wherein the rotating chuck comprises an oil motor, a reduction gearbox, a first transmission shaft, a second transmission shaft, a protecting tube, a rotating oil-separating tube, a fixed oil-separating tube, a slip assembly and a centralizer; the oil motor is arranged on the reduction gearbox; an output shaft of the oil motor is located in the reduction gearbox; the output shaft of the oil motor is provided with a driving gear; the first transmission shaft is provided in the reduction gearbox; the first transmission shaft and the second transmission shaft are arranged in the reduction gearbox; the first transmission shaft is provided with a first driven gear and a second driven gear; the second transmission shaft is provided in the reduction gearbox; the second transmission shaft is provided with a third driven gear and a fourth driven gear; the fixed oil-separating tube is arranged on a bottom plate of the reduction gearbox; an annular oil groove is arranged on a side of the fixed oil-separating tube; the fixed oil-separating tube is sleeved in the rotating oil-separating tube; the rotating oil-separating tube is provided with a fifth driven gear; the driving gear is engaged with the first driven gear; the second driven gear is engaged with the third driven gear; the fourth driven gear is engaged with the fifth driven gear; axes of the output shaft of the oil motor, the first transmission shaft, the second transmission shaft and the fixed oil-separating tube are parallel to each other and are located in the same plane; the protecting tube is connected to the reduction gearbox through a bolt; the slip assembly is arranged in the protecting tube and is connected to the rotating oil-separating tube; the centralizer is arranged on the protecting tube; the reduction gearbox is fixedly arranged on the support frame; and the fixed oil-separating tube is coaxial with the drill pipe.

8. The horizontal drilling machine of claim 4, wherein the damper comprises a first oil cylinder, a second oil cylinder, two slip assemblies, a top plate, a bottom plate and two side plates; the top plate, the bottom plate and the two side plates together form a square tubular structure; the square tubular structure is arranged on the support frame; the top plate is provided with a first drill pipe hole for the drill pipe to pass through; the bottom plate is provided with a second drill pipe hole for the drill pipe to pass through; the first and second drill pipe holes are coaxially provided; and the two slip assemblies are respectively arranged on both sides of the first and second drill pipe holes; and slips of the two slip assemblies are arranged opposite to each other; the first oil cylinder and the second oil cylinder are arranged on the support frame and respectively located at two ends of the square tubular structure; and piston rods of the first oil cylinder and the second oil cylinder are arranged opposite to each other, and are respectively connected to the two slip assemblies.

9. The horizontal drilling machine of claim 1, wherein the fishing device comprises a casing, a motor, a driving gear, a driven gear, a pneumatic piston, a trapezoidal cone head, an impact plate and an electromagnet; the casing has a barrel-shaped structure, and two ends of the casing are respectively provided with an end cover; the motor, the pneumatic piston and the impact plate are arranged in the casing; an inner cavity of the casing is divided by the impact plate into two cavities; the motor is arranged in one of the two cavities; an output shaft of the motor is provided with the driving gear; the driving gear is engaged with the driven gear; a rotating shaft of the driven gear is provided with a swing rod bearing; an end of a swing rod of the swing rod bearing is hinged with the pneumatic piston; the pneumatic piston is arranged in a piston cylinder; the piston cylinder is fixedly connected to the impact plate; the other of the two cavities is provided with the electromagnet, two transmission blocks and the trapezoidal cone head; the electromagnet is arranged at a middle of an end surface of the impact plate and is connected to the armored cable; a side wall of the casing is provided with two through holes; the two through holes are coaxial; the two transmission blocks are respectively in the two through holes, and are connected through a first spring; the trapezoidal cone head is arranged between the two transmission blocks; a smaller end of the trapezoidal cone head faces toward the electromagnet; and a second spring is arranged between a larger end of the trapezoid cone head and the end cover.

* * * * *